United States Patent [19]

Aoki

[11] 3,938,488

[45] Feb. 17, 1976

[54] DIESEL ENGINE FUEL INJECTION PUMP GOVERNOR

[75] Inventor: Hachiro Aoki, Higashimatsuyama, Japan

[73] Assignee: Diesel Kiki Co., Ltd., Tokyo, Japan

[22] Filed: May 22, 1974

[21] Appl. No.: 472,330

[30] Foreign Application Priority Data

June 1, 1973 Japan ..... 48-63929

[52] U.S. Cl. ..... 123/140R; 123/140 CC; 123/140 FP; 123/140 MC

[51] Int. Cl.[2] ..... F02D 1/04

[58] Field of Search ... 123/140 R, 140 MC, 140 FP, 123/140 CC

[56] References Cited

UNITED STATES PATENTS

| | | | |
|---|---|---|---|
| 3,577,968 | 5/1971 | Staudt | 123/140 R |
| 3,659,570 | 5/1972 | Yoshino | 123/140 R |
| 3,672,343 | 6/1972 | Biechl | 123/140 R |
| 3,759,236 | 9/1973 | Staudt | 123/140 R |
| 3,771,917 | 11/1973 | Davies | 123/140 R |
| 3,815,563 | 6/1974 | Stinsa | 123/139 R |

*Primary Examiner*—Wendell E. Burns
*Assistant Examiner*—Daniel J. O'Connor
*Attorney, Agent, or Firm*—Frank J. Jordan

[57] ABSTRACT

A control lever and a flyweight assembly move a floating lever which determines the position of a control rod which controls the fuel injection volume. Novel means are provided to prevent the control lever from being displaced by the floating lever during engine braking.

11 Claims, 3 Drawing Figures

DIESEL ENGINE FUEL INJECTION PUMP GOVERNOR

The present invention relates to a governor for a fuel injection pump for a Diesel internal combustion engine.

It has been proposed in the prior art to provide a governor assembly including a floating lever, the position of which is determined by a manual speed control lever and a flyweight assembly and which moves a control rod which controls the fuel injection volume. However, there is a major problem in the prior art design in that when engine braking is employed to slow down the vehicle, such as when moving downhill in low gear, although the vehicle operator has moved the control lever to the idling position, the action of the flyweights on the floating lever is such that the control lever will be moved thereby away from the idling position in the accelerating direction. This results in an unnatural sensation for the vehicle operator, and interferes with the engine braking operation. The present invention intends to provide novel means by which the control level will not unnaturally be moved by the floating lever during engine braking.

It is therefore an important object of the present invention to provide a governor for a fuel injection pump for a Diesel internal combustion engine by which the engine speed control lever and accelerator pedal are not moved from their idling position by the action of the governor floating lever during engine braking conditions.

The above and other objects, features and advantages of the present invention will become more clear from the following detailed description taken with the accompanying drawings, in which directions such as "clockwise" and "rightward" refer to the invention as viewed in the respective drawings, and in which.

Figure 1:
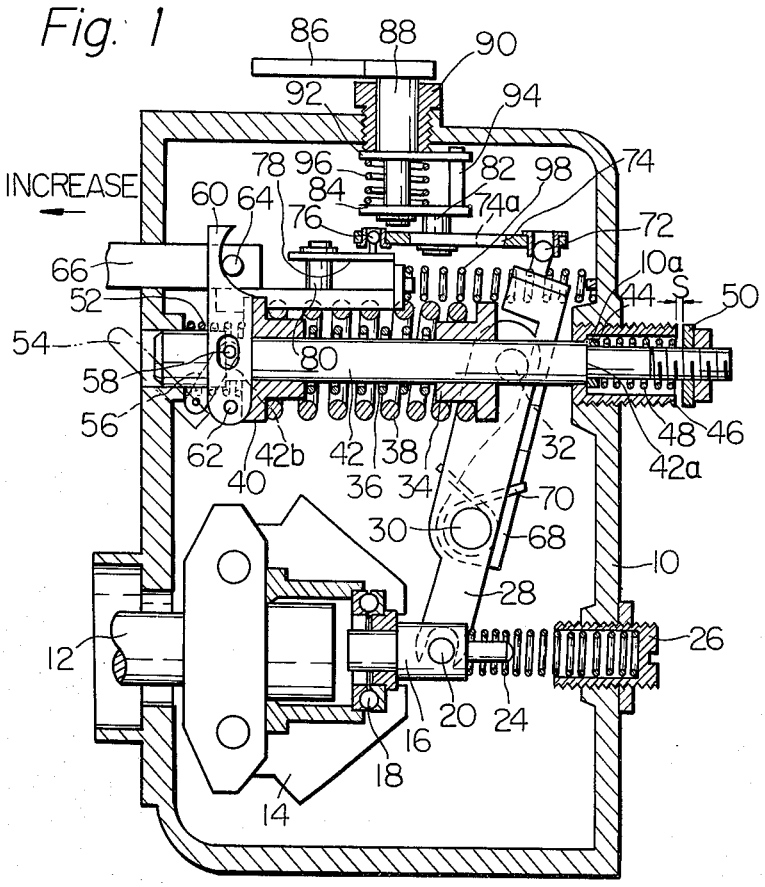
FIG. 1 is a longitudinal sectional view of a governor embodying the present invention.

Referring now to FIG. 1, a governor embodying the present invention includes a casing 10 rotatably supporting therein a shaft 12 rotatably driven by a camshaft of a Diesel engine fuel injection pump (not shown). The shaft 12 carries flyweights 14 which are arranged to expand by centrifugal force developed by rotation thereof by the shaft 12 and axially move a shifter rod 16 rightward as the engine speed increases. The shifter rod 16 engages with the flyweights 14 by means of a thrust bearing 18, and carries a pin 20. The shifter rod 16 is also formed with a right shoulder 16*a*, which engages with an idling spring 24. The preload of the idling spring 24 is adjustable by means of an adjusting nut 26. A tension lever 28 is rotatable about a fulcrum pin 30 supported by the casing 10, and is pivotally connected at one end to the pin 20. A pin 32 carried by the other end of the tension lever 28 is engagable with the right side of a spring seat 34, the other side of which is engagable with a medium speed governor spring 36 and a high speed governor spring 38. A spring seat 40 is engagable with the other ends of the springs 36 and 38, and is slidable on a shaft or rod 42 as is the spring seat 34. The rod 42 is slidably supported by the casing 10 and has a shoulder 42*a* formed near its right end which is engagable with the left side of a spring seat 44 which is also engagable with a shoulder 10*a* of the casing 10.

A bushing 46 is fixed to the casing 10 and receives the rod 42 therethrough. A compensating compression spring 48 is disposed inside the bushing 46, and engages at its right end with a nut 50 fixed to the end of the rod 42 and at its left end with the right side of the spring seat 44. The nut 50 is screwable along the rod 42 to provide a stroke S between its left side and the right side of the bushing 46. A spring 52 urges the spring seat 40 rightwards to eliminate play, and the rod 42 is formed with a shoulder 42*b* which is engagable with the left side of the spring seat 40.

A stopper lever 54 is manually rotatable to stop the engine, and has an extension 56 extending integrally therefrom and carrying at its end a pin 58. A link 60 is pivotally carried by the pin 58, and carries a pin 62 at its one end. The pin 62 is engagable with the left side of the spring seat 40, and the right side of the other end of the link 60 is engagable with the left side of a pin 64 fixed to a control rod 66. The control rod 66 is formed with a rack (not shown) which is operatively connected to the fuel injection pump to control the volume of fuel injected therefrom into the Diesel engine. The rack of the control rod 66 may engage with control guadrants of control sleeves of fuel injection valves (not shown) of the fuel injection pump, or be connected to control the fuel injection pump in any other manner. The control rod 66 is moved leftward as shown by an arrow to increase the fuel injection volume.

A guide lever 68 is pivotal about the fulcrum pin 30, and is biased counterclockwise against the pin 32 of the tension lever 28 by yieldable means in the form of a spring 70, and a ball 72 fixed to the upper end of the guide lever 68 pivotally engages in a hole (no numeral) formed through one end of a floating lever 74. A ball 76 fixed to one end of a link 78 pivotally engages in a hole (no numeral) formed through the other end of the floating lever 74. A pin 80 is fixed to the control rod 66, and pivotally supports the link 78.

Figure 2:
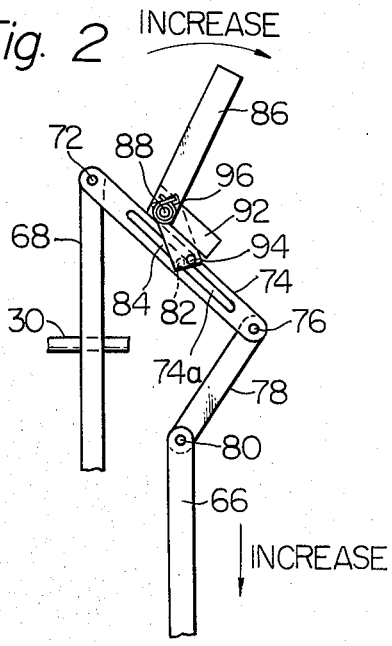
FIG. 2 is a top view, partly in section, of a portion of the governor of FIG. 1.

Referring now also to FIG. 2, the floating lever 74 is formed with a longitudinal slot 74*a*, in which a pin 82 of an arm 84 is movably received. A control member or lever 86, which may be connected to an accelerator pedal of a vehicle through a suitable linkage (not shown), is fixed on a shaft 88 which is rotatably supported by the casing 10 by a bushing 90. An arm 92 is fixed to the shaft 88, and is engagable with a pin 94 extending from the arm 84. The arm 84 is urged by a spring 96 so that the pin 94 engages with the arm 92. The control rod 66 is urged leftward by a starting spring 98.

The operation of the governor will now be described.

When the engine is shut down, the control lever 86 will be in its maximum counterclockwise position and the control rod 66 will be in its maximum upward position as shown in FIG. 2. To start the engine, the control lever 86 is rotated to its maximum clockwise position to provide maximum fuel injection volume for starting. In FIG. 2, the control lever 86 is rotated clockwise and the arm 92 engages with the pin 94 to move the arm 84 and thereby the pin 82 clockwise. Since the engine speed is almost zero, the flyweights 14 will not be moved and the shifter rod 16 will assume its maximum leftward position in FIG. 1. Also as viewed in FIG. 1, the tension lever 28 will assume its maximum clockwise position.

The guide lever 68 will assume its maximum counterclockwise position as viewed in FIG. 1 due to the force of the spring 70, and the ball 72 will serve as a fixed pivot point for the floating lever 74. Referring now to FIG. 2, as the pin 82 is moved clockwise, it will exert a force on the floating lever 74 to pivot the same clockwise about the ball 72. This will cause the control rod 66 to be moved downward in the direction to increase the fuel injection volume by means of the link 78 and the starting spring 98. When the position of maximum fuel injection volume is reached, the pin 64 of the control rod 66 will abut against the link 60, which will in turn be rotated about the pin 58 until the pin 62 abuts against the spring seat 40. Due to the high stiffness of the springs 36 and 38, further movement of the control rod 66 will be prevented.

After starting, the control lever 86 is rotated counterclockwise in FIG. 2 to an idling position. The arm 84 is urged by the spring 96 to follow the arm 92, and the floating lever 74 is pivoted counterclockwise about the ball 72 by the pin 82. The control rod 66 is pulled upward thereby to an idling position.

The tension lever 28 and guide lever 68 normally rotate as a unit. As the engine speed approaches the idling speed, the flyweights 14 expand and the shifter rod 16 is moved rightward in FIG. 1 against the force of the idling spring 24. The guide lever 68 and tension lever 28 will then rotate counterclockwise. Referring to FIG. 2, counterclockwise rotation of the guide lever 68 will cause counterclockwise rotation of the floating lever 74 about the pin 82. The control rod 66 will thereby be moved upward to reduce the fuel injection volume.

As the control lever 86 is rotated clockwise in FIG. 2 to increase the engine speed, the floating lever 74 is pivoted clockwise thereby about the ball 72, and the control rod 66 is moved downward to increase the fuel injection volume. As viewed in FIG. 1, as the engine speed increases, the tension lever 28 and guide lever 68 will be rotated counterclockwise by the flyweights 14 and the shifter rod 16. The pin 32 will urge the spring seat 34, springs 36 and 38 and spring seat 40 leftward against the force of the spring 52, which is weak, until the left side of the spring seat 40 abuts against the shoulder 42b of the rod 42. The rod 42 will then be moved leftward against the force of the compensating spring 48, which serves to correctly determine the maximum fuel injection volume during the transition between idling and medium speed engine operation. After the rod 42 has been moved leftward by a distance corresponding to the stroke S, the left side of the nut 50 will abut against the right side of the bushing 46, and further movement of the rod 42 will be prevented.

At or slightly before this point, the left side of the spring seat 40 will engage with the pin 62 and rotate the link 60 clockwise. If the control rod 66 should be thereafter moved leftward into engagement with the link 60, further movement thereof will be prevented. It will be understood that the tension lever 28, spring seats 34 and 40, springs 36, 38, 48 and 52, rod 42 and link 60 serve to limit the maximum fuel injection volume to a point above which smoky exhaust gas would be produced, and that the floating lever 74 and associated parts serve to suitably adjust the fuel injection volume to an optimum value below the maximum allowable value based on the engine speed demand and instantaneous engine speed.

As the engine speed increases, and the tension lever 28 rotates further counterclockwise, the spring 36 and thereafter the spring 38 will be compressed between the spring seats 34 and 40. The maximum clockwise position of the link 60 will not change, however, indicating that the maximum fuel injection volume not producing smoky exhaust is constant above the engine speed at which the nut 50 engages with the bushing 46. The guide lever 68 rotating counterclockwise will rotate the floating lever 74 counterclockwise as viewed in FIG. 2 about the pin 82. The control rod 66 will be thereby moved upward to decrease the fuel injection volume as the engine speed increases since extra fuel is not required for further acceleration.

Figure 3:
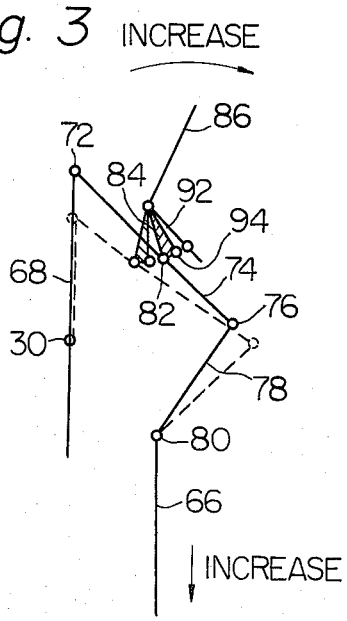
FIG. 3 is a diagrammatic view of the portion of the governor shown in FIG. 2.

The condition of engine braking, such as when the vehicle is moving downhill, is illustrated in FIG. 3. Under this condition, the engine speed is high and the control lever 86 is in the idling position. The positions of the parts shown in solid line correspond to normal idling conditions, and the positions shown in broken line correspond to engine braking conditions, under which the engine is being used as a brake to slow down the vehicle. For simplicity of description, it will be assumed that the vehicle is initially coasting on a level portion of a highway with the control lever 86 in the idling position, and then starts moving downhill. The guide lever 68 will be rotated by the flyweights 14 from the position in solid line to the position in broken line since the engine will be driven by the vehicle wheels and the engine speed will increase. Since the control rod 66 is in the minimum fuel injection position, and cannot be moved farther to decrease the fuel injection volume, the pin 80 will serve as a fixed pivot point. The floating lever 74 and link 78 will move as shown. Since the pin 82 must at all times be within the slot **74*a*, the pin 82 and arm 84 will be rotated clockwise. If the control lever 86 was fixedly rotatable with the arm 84 as in the prior art, the control lever 86 would be rotated by the floating lever 74 clockwise in the direction to increase the fuel injection volume as described above. However, with the provision of yieldable means including the spring 96, the arm 84 is able to rotate clockwise but the control lever 86 will remain in the position shown in solid line. In the present example, the spring 70 is stiffer than the spring 96, so the latter will yield before the former. When the guide lever 68 has been moved to the position shown in broken line in FIG. 3, which is considered to be the operating limit of the floating lever 74 and with the control lever 86 in the idling position and the engine speed above a predetermined value, the spring 70 will yield, and further rotation of the guide lever 68 will be prevented even though the tension lever 28 continues to rotate. In this way, the floating lever 74 and link 78** will not be broken by movement past their operating limit.

If desired, the spring 96 may be omitted and the arm 84 fixed for rotation with the shaft 88. In this case, as the engine speed rises, movement of the guide lever 68 and thereby the floating lever 74 and control lever 86 will be prevented since the spring 70 will yield and the guide lever 68 will not rotate counterclockwise in FIG. 1 even though the tension lever 28 is rotated counterclockwise by the flyweights 14 and shifter rod 16. Thus, the unnatural phenomenon of the control lever 86 being moved by the floating lever 74 during engine braking is eliminated by the present invention.

To shut down the engine, the stopper lever 54 is rotated clockwise as shown in FIG. 1 to move the link 60 and control rod 66 to maximum rightward positions to completely shut off fuel injection.

What is claimed is:

1. A governor for an engine fuel injection pump comprising:

a fuel control rod adapted to be connected to the fuel injection pump to control the fuel injection volume;

flyweights;

governor spring means;

a manual engine speed control member; and a first linkage operatively connecting the flyweights and the control member to the control rod, the first linkage comprising a tension lever having an intermediate fulcrum and being pivotally connected at one end to the flyweights and engagable at its other end with the governor spring means to connect the flyweights to the governor spring means in such a manner that the flyweights move against the force of the governor spring means as the engine speed rises, a guide lever pivotal about the same point as the tension lever, a floating lever rotatably connected at an intermediate point to the control member, the floating lever being pivotally connected at one end to the end of the guide lever and being pivotally connected at its other end to the control rod, and biasing means urging the guide lever to rotate with the tension lever, the biasing means normally operatively maintaining the guide lever in engagement with the tension lever and being arranged to yield and allow the tension lever to disengage from the guide lever when the control member is in a low engine speed demand position and the engine speed is above a predetermined value.

2. A governor according to claim 1, further comprising yieldable means arranged to normally operatively connect the control member to the floating lever and to yield when the control member is in a low speed demand position and the engine speed is above a predetermined value to prevent the control member from being moved by the first linkage.

3. A governor according to claim 1, in which the first linkage further comprises:

a first rod axially movable by the flyweights;

an idling spring, the first rod moving against the force of the idling spring as the engine speed rises, said one end of the tension lever being pivotally connected to the first rod;

a second rod slidable carrying thereon the governor spring means and first and second spring seats engagable with the opposite ends of the governor spring means, said other end of the tension lever being engagable with the first spring seat;

a first link pivotally connected at one end to said other end of the floating lever and pivotally connected at its other end to the control rod;

the governor further comprising a second linkage which includes:

a second link having an intermediate fulcrum and pivotally engaging at one end with the second spring seat and at the other end with the control rod;

the governor further comprising yieldable means which includes:

an arm rotatable about a fixed point and carrying a first pin slidable in a longitudinal slot formed through the floating lever and a second pin, the control member being engagable with the second pin when rotated in one direction; and second biasing means to urge the arm in a direction to engage the second pin with the control member; whereby when the control member is in the low engine speed demand position and the engine speed is above the predetermined value, the flyweights move the first rod to thereby move the tension lever, but the guide lever remains stationary against the force of the biasing means so that the control member remains in the low engine speed demand position.

4. A governor according to claim 3, further comprising a stopper member pivotally connected to the fulcrum of the second link and being manually movable to move the second link and thereby the control rod to a position of substantially zero fuel injection volume for stopping the engine.

5. A governor according to claim 3, further comprising a compensating spring, the second rod being movable within a limited range and being engagable with the compensating spring in such a manner that the flyweights move against the forces of the idling spring and the compensating spring in an engine speed range between idling and medium speed prior to moving against the force of the governor spring means.

6. A governor according to claim 1, further comprising a second linkage engagable with the flyweights and the control rod to limit the fuel injection volume to a predetermined level above which smoky exhaust gas is produced.

7. A governor according to claim 1, in which the governor spring means is in a substantially free state when the engine speed is zero.

8. In a governor for an engine fuel injection pump having a fuel control rod adapted to be connected to the fuel injection pump to control the fuel injection volume, flyweights, governor spring means, a manual engine speed control member, a first linkage including an idling spring, a first rod axially movable by the flyweights and engaging at one end with the idling spring, a tension lever having an intermediate fulcrum and being pivotally connected at one end to the first rod, a second rod slidably carrying thereon the governor spring means and first and second spring seats engagable with the opposite ends of the governor spring means, the other end of the tension lever being engagable with the first spring seat so that the flyweights move against the force of the governor spring means as the engine speed rises, a guide lever pivotal about the same point as the tension lever, a floating lever, the guide lever being pivotally connected at its end to one end of the floating lever, a first link, one end of the first link being pivotally connected to the other end of the floating lever and the other end of the first link being pivotally connected to the control rod, a second linkage including a second link having an intermediate fulcrum and pivotally engagable at one end with the second spring seat and at its other end with the control rod, the improvement comprising:

biasing means urging the guide lever to rotate with the tension lever, the biasing means normally operatively maintaining the guide lever in engagement with the tension lever and being arranged to yield when the control member is in a low engine speed demand position and the engine speed is above a predetermined value to prevent the control member from being moved by the floating lever, and yieldable means including an arm rotatable about a fixed point and carrying a first pin slidable in a longitudinal slot formed through the floating lever and a second pin, the control member being engagable with the second pin when rotated in one direction, and second biasing means to urge the arm in a direction to engage the second pin with the control member so that when the control member is in the low engine speed demand position and the engine speed is above the predetermined value, the flyweights move the first rod to thereby rotate the tension lever, but the guide lever remains stationary against the force of the biasing means so that the control member remains in the low engine speed demand position.

9. The improvement according to claim 8, further comprising a compensating spring, the second rod being movable within a limited range and being engagable with the compensating spring in such a manner that the flyweights move against the forces of the idling spring and compensating spring in an engine speed range between idling and medium speed prior to moving against the force of the governor spring.

10. The improvement of claim 8, further comprising a stopper member pivotally connected to the fulcrum of the second link and being manually movable to move the second link and thereby the control rod to a position of substantially zero fuel injection volume for stopping the engine.

11. The improvement of claim 8, in which the governor spring means is in a substantially free state when the engine speed is zero.

* * * * *